United States Patent [19]

Floet et al.

[11] 4,170,097

[45] Oct. 9, 1979

[54] APPARATUS FOR PACKAGING AN OBJECT

[75] Inventors: Wilhelmus F. W. Floet, Bloemendaal; Hermanus N. Heijke, Zaandijk, both of Netherlands

[73] Assignee: Amtac B.V., Wormer, Netherlands

[21] Appl. No.: 892,013

[22] Filed: Mar. 31, 1978

[30] Foreign Application Priority Data

Apr. 7, 1977 [NL] Netherlands ..... 7703834

[51] Int. Cl.[2] ..... B65B 43/00; B65B 67/02

[52] U.S. Cl. ..... 53/567; 53/390

[58] Field of Search ..... 53/469, 390, 581, 567

[56] References Cited

U.S. PATENT DOCUMENTS

| | | | |
|---|---|---|---|
| 3,529,401 | 9/1970 | Sartore et al. | 53/390 X |
| 3,719,022 | 3/1973 | Cherio et al. | 53/390 X |
| 4,002,006 | 1/1977 | Bruno | 53/390 X |

*Primary Examiner*—Travis S. McGehee

*Attorney, Agent, or Firm*—Lane, Aitken & Ziems

[57] ABSTRACT

A method for packaging an object, in particular a root ball of a tree, shrub or plant. The object to be packaged is placed in a socket which is surrounded by an elastic reticulate hose, whereupon the object is removed from the socket, during which operation the hose is carried along, this hose subsequently being severed beyond the object.

An apparatus used for packaging an object, in particular a root ball of a tree, shrub or plant. This apparatus comprises a socket into which the object to be packaged is introduced, as well as a stock of elastic reticulate hose material from which hoses are formed to surround the socket.

8 Claims, 3 Drawing Figures

APPARATUS FOR PACKAGING AN OBJECT

BACKGROUND OF THE INVENTION

The invention relates to a method of packaging an object, in particular a root ball (a clot of earth surrounding the roots) of a tree, shrub or plant; as well as to an apparatus for packaging an object with the use of this method.

It has so far been common practice to package the root balls of trees, shrubs or plants intended for transport and sale in jute, sheets of plastic or other packaging material. This packaging is done by hand, the root ball being placed on a piece of packaging material, whereupon the edges thereof are folded together above the root ball and are tied up. This way of packaging has the disadvantage of being particularly cumbersome and time-consuming.

SUMMARY OF THE INVENTION

It is a first object of the present invention to provide a method of packaging an object, in particular a root ball of a tree, shrub or plant, which can be carried out substantially faster and more efficiently than the known method.

It is a further object of the present invention to provide an apparatus for packaging an object, in particular a root ball of a tree, shrub or plant, with which the packaging can take place in a very fast and efficient manner.

The method according to the invention is characterized in that the object to be packaged is placed in a socket which is surrounded by an elastic reticulate hose, whereupon the object is removed from the socket, during which operation the hose is carried along, this hose subsequently being severed beyond the object.

The use of an elastic reticulate hose as packaging material results in the major advantage of eliminating the cumbersome operations of folding together and tying the packaging material so that appreciable savings in labour are attained. The hose furthermore applies some pressure to the object to be packaged, causing it to be adequately held together where this may be required.

While the object is being removed from the socket, the end portion of the hose can be grasped by hand so as to displace the hose together with the object.

The object can furthermore be removed mechanically from the socket, if required.

An important embodiment of the method according to the invention is characterized in that the introduction of the object into the socket is followed by a displacement of the hose and this socket relative to each other, in such a way that the hose is moved further over the socket. This greatly facilitates the joint displacement of the hose and the object during the removal of the object from the socket.

To this end, it is specifically proposed according to the invention that the socket in upright position is loosely carried by a support, the hose being passed between the support and the socket, in such a way that the hose is displaced upwardly along the socket under the action of gripping elements and the socket is carried along by the hose over a short distance before striking a stop.

With this method, the elastic reticulate hose can be supplied with great advantage from a roll.

In order to strengthen the package in cases where this may be required, the elastic reticulate hose can be provided on the object in a plurality of layers.

The apparatus according to the invention is characterized by a socket into which the object to be packaged is introduced, as well as by a stock of elastic reticulate hose material from which hoses are formed to surround the socket.

In a favourable embodiment of the apparatus according to the invention, means are used for moving the hose and the socket relatively to each other in such a way that the hose is moved further over the socket.

This can be attained by arranging a plurality of gripping elements around the socket which is supported in its upright position, which gripping elements can be moved upwards and downwards and which engage the hose during their upward stroke so as to move the hose upwardly along the socket, but which release the hose during their downward stroke.

This upright socket can be loosely carried by a support and be capable of a slight upward displacement in relation to this support, which upward movement of the socket is limited by a stop.

The invention furthermore relates to an object, in particular a root ball of a tree, shrub or plant, packaged with the use of the method described hereinbefore and characterized in that an elastic reticulate hose is used as packaging material.

The invention finally comprises an elastic reticulate hose intended for use with the method described hereinabove.

BRIEF DESCRIPTION OF THE DRAWING

The invention will be explained hereinafter with reference to the drawing which illustrates an embodiment of an apparatus according to the invention by way of example.

DESCRIPTION OF A PREFERRED EMBODIMENT

Figure 1:
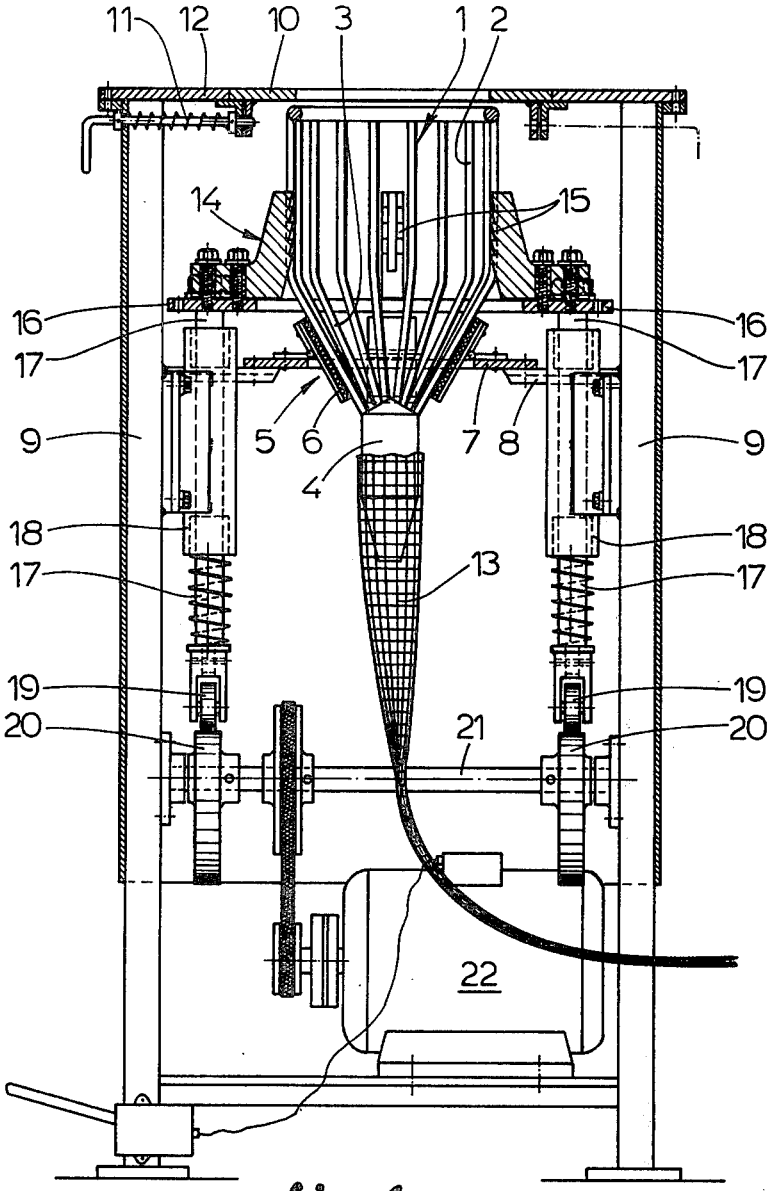
FIG. 1 is a diagrammatic lateral view of an embodiment of the apparatus according to the invention.

The apparatus shown in the drawings serves specifically for packaging a root ball (a clot of earth surrounding the roots) of a tree, shrub or plant, before this tree, shrub or plant is transported.

The apparatus comprises an upright socket 1 in which the root ball which is to be packaged can be placed. In the example shown, this socket 1 is composed of a cylindrical top part 2, a conical bottom part 3 and a central core 4 which is attached underneath this bottom part 3. The cylindrical top part 2 and the conical bottom part 3 are built up of rods, whereas the central core 4 is preferably solid so as to increase the weight of the socket 1.

The socket 1 is loosely carried by a support 5 which, in the embodiment shown, consists of supporting elements 6 which are supported by a horizontal ring 7 and may pivot about horizontal axes and which can come into supporting contact with the conical bottom part 3 of the socket 1 (FIG. 1). The ring 7 is detachably fastened to horizontal arms 8, which are fixed to the machine frame 9.

This machine frame 9 carries at its upper side a stop ring 10, the inner circumference of which is at least substantially aligned with the top edge of the socket 1. A small gap is arranged between the stop ring 10 and the top edge of the socket 1. As the drawing indicates, the stop ring 10 is detachably connected to the upper plate 12 of the machine frame 9 with the aid of spring-loaded pins 11.

An elastic reticulate hose 13 is supplied from a roll. This hose 13 is moved over the central core 4 underneath the socket 1 and is passed between the supporting elements 6 and the socket 1, so that the hose 13 surrounds the entire socket 1 and may protrude over some distance above the socket 1.

Figure 3:
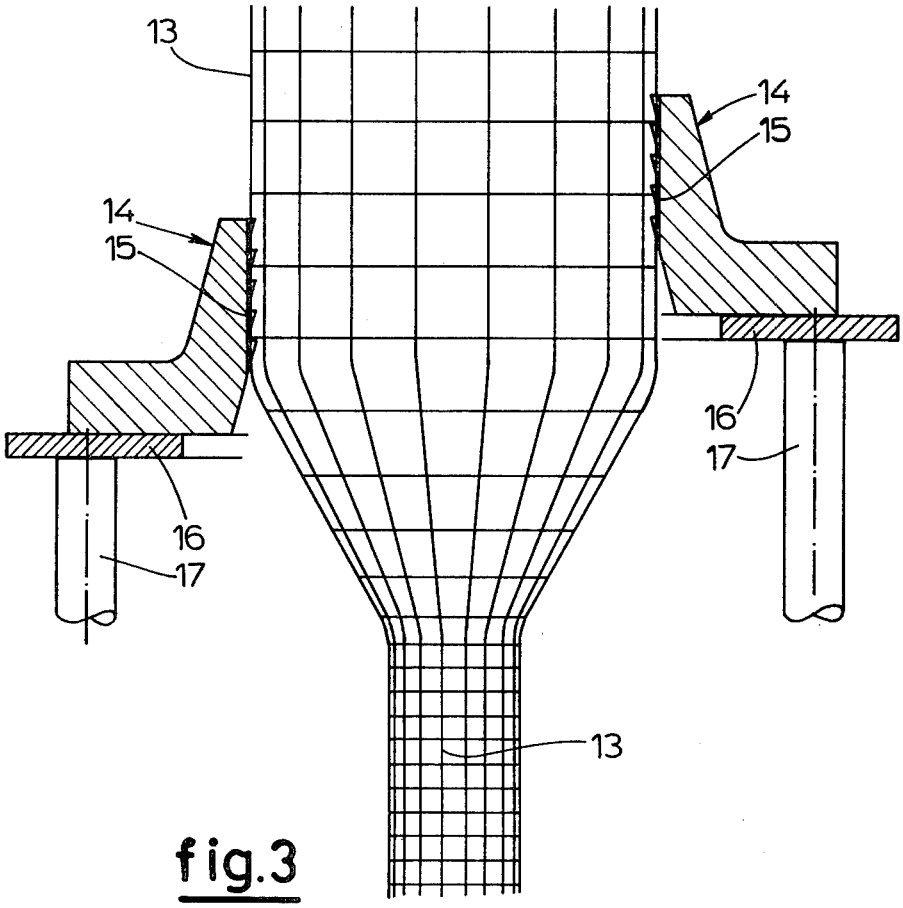
FIG. 3 is a highly diagrammatic view of the hose and of the gripping elements in the positions of FIGS. 1 and 2 on a larger scale.

A plurality of gripping elements 14, arranged around the socket 1 between the rods thereof, can move up and down, engaging the horizontal threads of the hose 13 during their upward stroke (FIG. 3) and displacing the hose 13 upwardly, but releasing these horizontal threads of the hose 13 during their downward stroke.

In the example shown, these gripping elements 14 are provided with gripping claws 15 that are operative in one direction only. These gripping elements 14 are fastened detachably and adjustably to a horizontal ring 16, which in the example shown is supported by vertical rods 17 guided in sleeves 18 that are attached to the machine frame 9. The rods 17 carry lower rollers 19 which are kept in contact with cams 20 under the influence of springs. These cams 20 are secured on a shaft 21 which is driven by an electric motor 22 through a transmission.

Of course, it is possible to use other driving elements for the upward and downward motion of the ring 16, such as hydraulic or pneumatic elements.

Instead of the gripping elements 14 with their reciprocating motion, use can also be made of other elements for realizing a displacement of the hose 13 and the socket 1 relative to each other, in such a way that the hose 13 is moved upwardly over the socket 1.

Figure 2:
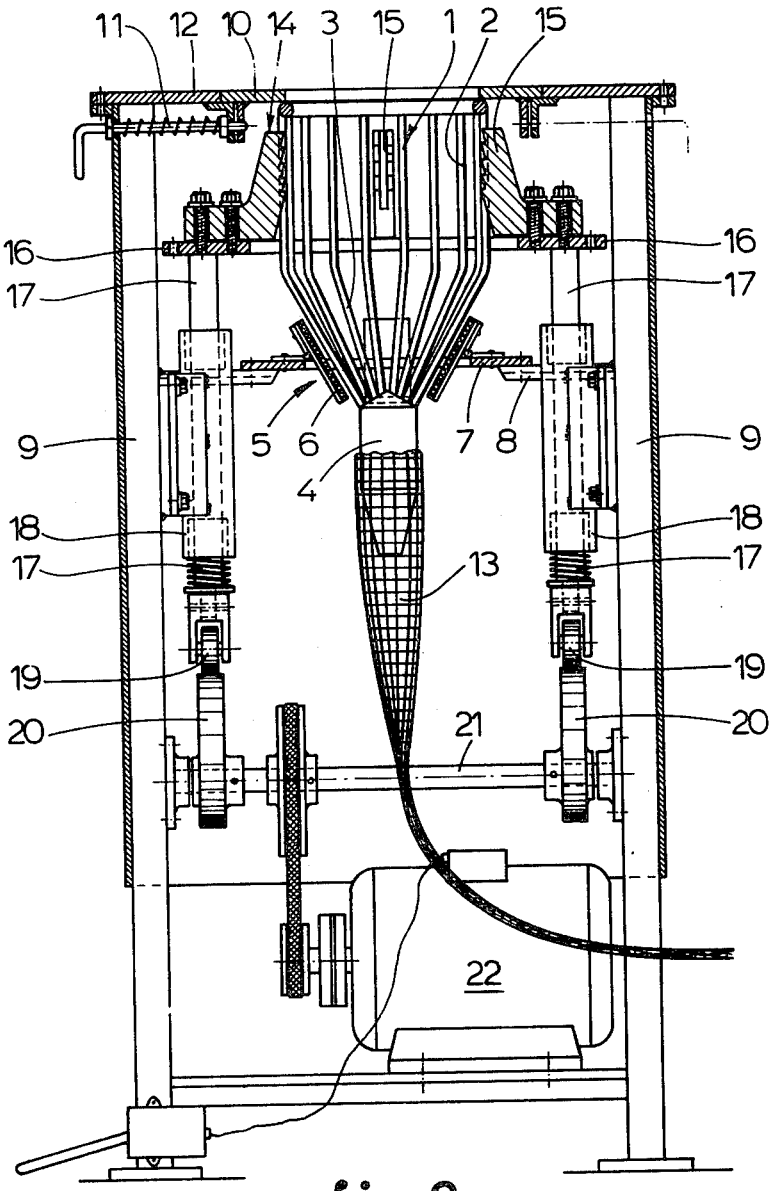
FIG. 2 is a lateral view corresponding to FIG. 1 in a different working position.

When the root ball of a tree, shrub or plant has been placed in the socket 1, the motor 22 is turned on, causing a reciprocating vertical motion to be imparted to the ring 16 and the gripping elements 14. As a result, the gripping elements 14 will act upon the hose 13 and pull this hose upwardly over the socket 1. Each upward stroke of the gripping elements 14 causes the socket 1 to be entrained over a short distance by the hose 13 until this socket 1 strikes the stop ring 10 (FIG. 2). This creates a slight amount of clearance between the conical bottom part 3 of the socket 1 and the supporting elements 6, which facilitates the upward motion of the hose 13 along the socket 1. The socket 1 and the hose 13 can be moved downwardly over a slight distance during the downward stroke of the gripping elements 14, until the socket 1 rests upon the supporting elements 6. As a result, an upper gap is formed for the passage of the hose 13.

During the upward motion of the hose 13 along the socket 1, the tree, shrub or plant can be lifted, while the hose 13, on account of its upward feed, will continue to surround the root ball automatically. Once the root ball has been lifted entirely from the socket 1, the hose 13 is severed underneath the root ball, whereupon the hose 13 closes itself elastically and can even be closed further if required. The apparatus is then ready for packaging a subsequent root ball.

When the hose 13 protrudes over some distance above the socket 1, the end of the hose can be turned down around the root ball into the socket 1, so that the hose 13 is eventually applied in two layers on the root ball.

Since the socket 1 as well as the supporting elements 6, the gripping elements 14 and the stop ring 10 can be readily detached and substituted, the apparatus can be adapted with particular ease for packaging objects of different dimensions or shapes.

In addition to the packaging of root balls of trees, shrubs or plants, the apparatus according to the invention can also be used for packaging numerous other objects, such as products of agriculture or horticulture, industrial products or waste products.

The invention is not restricted to the example shown in the drawing, which can be varied in various manners within the scope of the invention.

I claim:

1. An apparatus for packaging an object such as a root ball of a tree, shrub or plant, said apparatus comprising a socket which is supported in a substantially upright position and into which the object to be packaged is introduced, a stock of elastic reticulate hose material from which hoses are formed to surround the socket, a plurality of gripping elements arranged around the upright socket which are adapted to be moved upwards and downwards by a driving means, said gripping elements engaging the hose surrounding the socket during their upward stroke so as to move the hose upwardly along the socket but releasing the hose during their downward stroke, the upright socket being loosely carried by a support and being capable of a slight upward displacement with respect to the support, said upward displacement of the socket being limited by a stop.

2. The apparatus of claim 1, wherein the stop comprises a ring, the inner circumference of which is aligned at least substantially with the top edge of the socket.

3. The apparatus of claim 2, wherein the gripping elements are provided with gripping claws which are operative to engage the hose in one direction only.

4. The apparatus of claim 3, wherein the gripping elements are fastened detachably to a horizontal ring which is adapted to be moved upwardly and downwardly by the driving means.

5. The apparatus of claim 1, wherein the socket comprises a cylindrical top part, a conical bottom part and a solid central core attached underneath the bottom part, the top part and the bottom part being formed of rods.

6. The apparatus of claim 5, wherein said support consists of supporting elements which are hingeably supported by a detachable carrier ring and which are in contact with the conical bottom part of the socket in the lower position of said socket.

7. The apparatus of claim 6, wherein the carrier ring is detachably supported.

8. The apparatus of claim 7, wherein the stop ring is detachably supported.

* * * * *